US010755687B2

(12) United States Patent
Pauley

(10) Patent No.: US 10,755,687 B2
(45) Date of Patent: Aug. 25, 2020

(54) THIN FILM RESONATORS

(71) Applicant: Douglas K. Pauley, Downey, CA (US)

(72) Inventor: Douglas K. Pauley, Downey, CA (US)

(73) Assignee: Out of the Box Audio, LLC, Downey, CA (US)

( * ) Notice: Subject to any disclaimer, the term of this patent is extended or adjusted under 35 U.S.C. 154(b) by 0 days.

(21) Appl. No.: 16/153,402

(22) Filed: Oct. 5, 2018

(65) Prior Publication Data

US 2019/0115005 A1 Apr. 18, 2019

Related U.S. Application Data

(60) Provisional application No. 62/572,286, filed on Oct. 13, 2017.

(51) Int. Cl.
*G10K 11/172* (2006.01)
*G10K 11/04* (2006.01)
(Continued)

(52) U.S. Cl.
CPC ..... *G10K 11/172* (2013.01); *G10K 11/04* (2013.01)

(58) Field of Classification Search
CPC ..... G10K 11/172; G10K 11/16; G10K 11/02; G10K 11/04; E04B 2001/8485; E04B 2001/848
See application file for complete search history.

(56) References Cited

U.S. PATENT DOCUMENTS 3,112,008 A * 11/1963 Ludlow ..... G10K 11/172 138/37
3,429,397 A * 2/1969 Case ..... F01N 1/006 181/227

(Continued)

FOREIGN PATENT DOCUMENTS

JP 2016-539549 A 12/2016

OTHER PUBLICATIONS

V.M. Garcia-Alcaide, S. Palleja-Cabre, R. Castilla, P. J. Gamez-Montero, J. Romeu, T. Pamies, J. Amate & N. Milan (2017) Numerical study of the aerodynamics of sound Engineering Applications of Computational Fluid Mechanics, 11:1, 210-224, DOI: 10.1080/19942060.2016.1277166.

(Continued)

*Primary Examiner* — Edgardo San Martin
(74) *Attorney, Agent, or Firm* — Fish IP Law, LLP

(57) ABSTRACT

Thin film resonators are deployed in the port ducts of speakers, musical instruments, microphones, and other devices having an important auditory component, to reduce distortion and/or improve other sound qualities. Preferred resonators have a resonator sheet with a first air cavity, and a passageway in an edge of the resonator sheet that opens to the air cavity. The cavity is further defined by a cover sheet, and preferably also a base sheet. The sheets are preferably bonded together by an adhesive. Resonators can be deployed rolled up inside a duct, slightly curved, or laying substantially flat on a surface over which air is flowing. Resonators can be deployed during and/or post manufacturing. Cavities are preferably elliptically shaped, and deployed as substantially mirror image pairs. Openings to the cavities can be positioned on one or more edges of the resonators.

24 Claims, 10 Drawing Sheets

(51) Int. Cl.
*G10K 11/16* (2006.01)
*G10K 11/02* (2006.01)

(56) References Cited

U.S. PATENT DOCUMENTS 3,893,782 A * 7/1975 Pierpoline ..... F01D 5/26 415/119
4,135,603 A * 1/1979 Dean, III ..... G10K 11/172 181/286
4,531,362 A * 7/1985 Barry ..... F01D 25/06 415/119
5,014,816 A * 5/1991 Dear ..... F01N 1/02 181/229
6,009,705 A * 1/2000 Arnott ..... F01N 1/02 123/184.57
6,375,416 B1 * 4/2002 Farrell ..... F01D 11/08 415/10
6,435,303 B1 * 8/2002 Warnaka ..... E04B 1/86 181/286
6,719,078 B2 * 4/2004 Nakamura ..... F02M 35/10013 180/69.22
6,799,657 B2 * 10/2004 Daniels ..... F04B 53/002 181/175
6,973,790 B2 * 12/2005 Suenaga ..... F23M 20/005 181/213
8,453,791 B2 * 6/2013 Wakatsuki ..... F01N 1/02 181/227
9,057,313 B2 * 6/2015 Heeb ..... F01N 13/00
9,343,059 B2 * 5/2016 Wilson ..... G10K 11/172
9,378,721 B2 * 6/2016 Zalewski ..... G10K 11/172
2002/0094108 A1 7/2002 Yanagawa et al.
2007/0295554 A1 * 12/2007 Flucht ..... F02M 35/1216 181/213
2015/0256144 A1 9/2015 Andosca et al.
2016/0021465 A1 1/2016 Miyoshi
2019/0055968 A1 * 2/2019 Pauley ..... H04R 1/2811

OTHER PUBLICATIONS

Vorgelet Von, Diplom-Ingenieur, Frank Urzynicok, Aus Berlin; Separation Control by Flow-Induced Oscillations of a Resonator; (2003); Tag der wissenschaftlichen Aussprache; pp. 1-206; Berlin.
Andreas Schroeder, Christian E.Willert; PIV_BASS_REFLEX_LOUDSPEAKERS; Particle Image Velocimetry, New Developments and Recent Applications; Topics in Applied Physics, vol. 112; (Dec. 2007); pp. 259 to 270; Göttingen, Germany.
International Search Report for PCT/US2018/054734 dated Feb. 1, 2019, 3 pages.

* cited by examiner

FIG. 5D
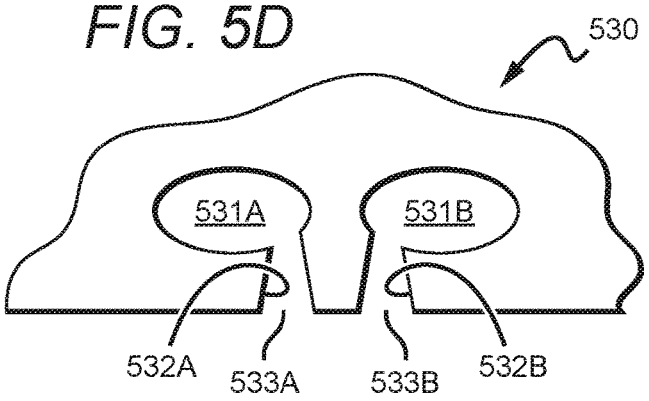
FIG. 5E
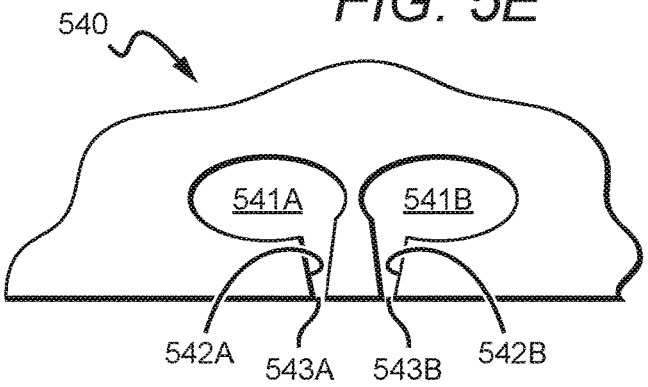
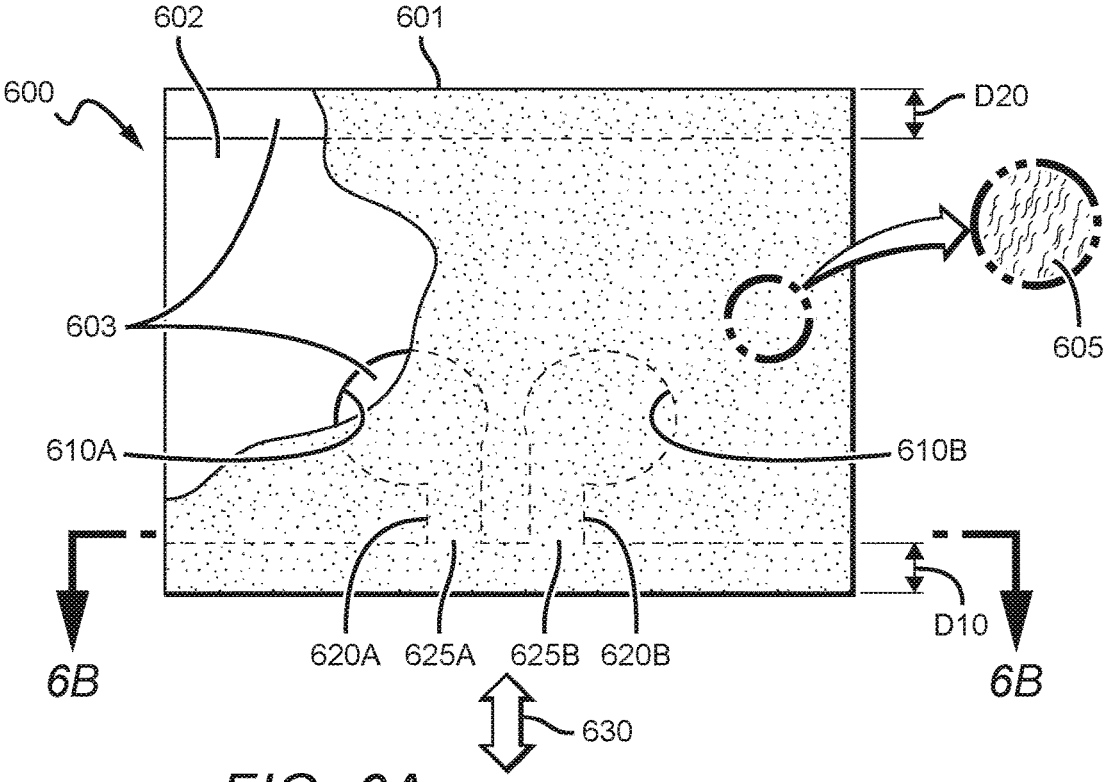
FIG. 6A

FIG. 10
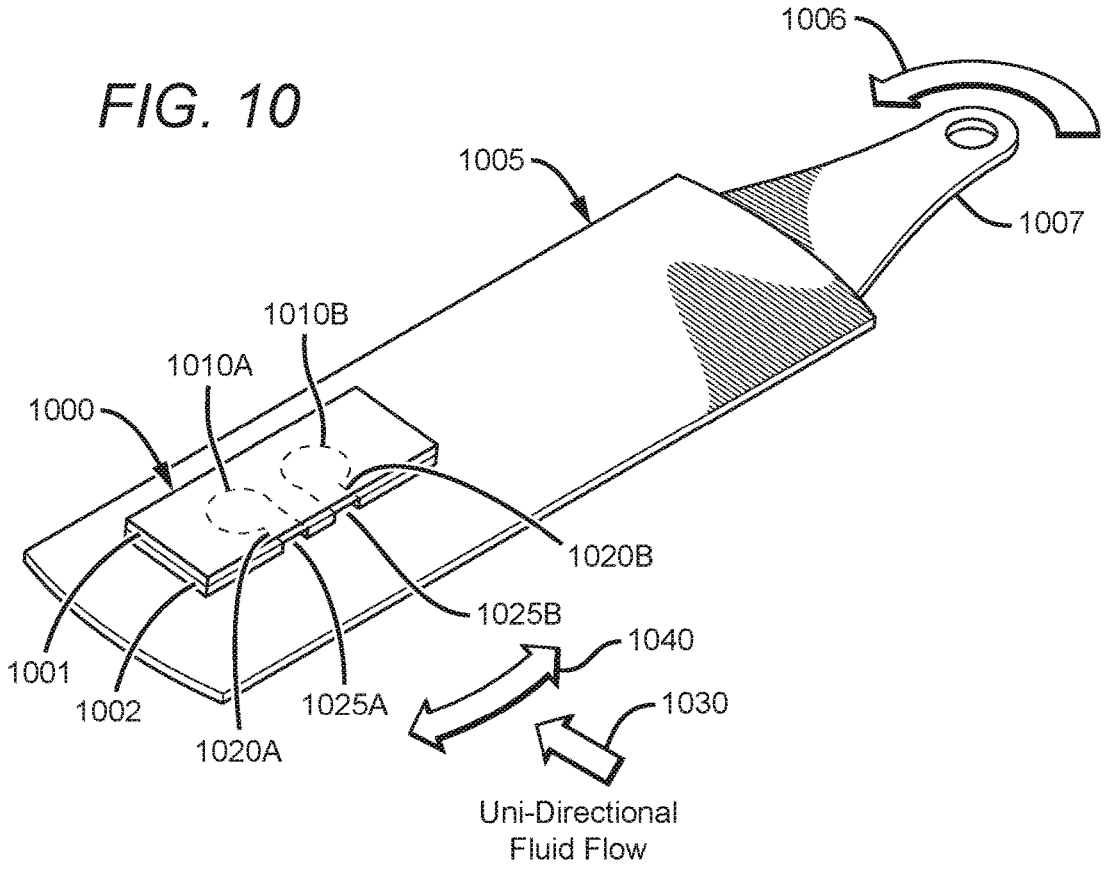
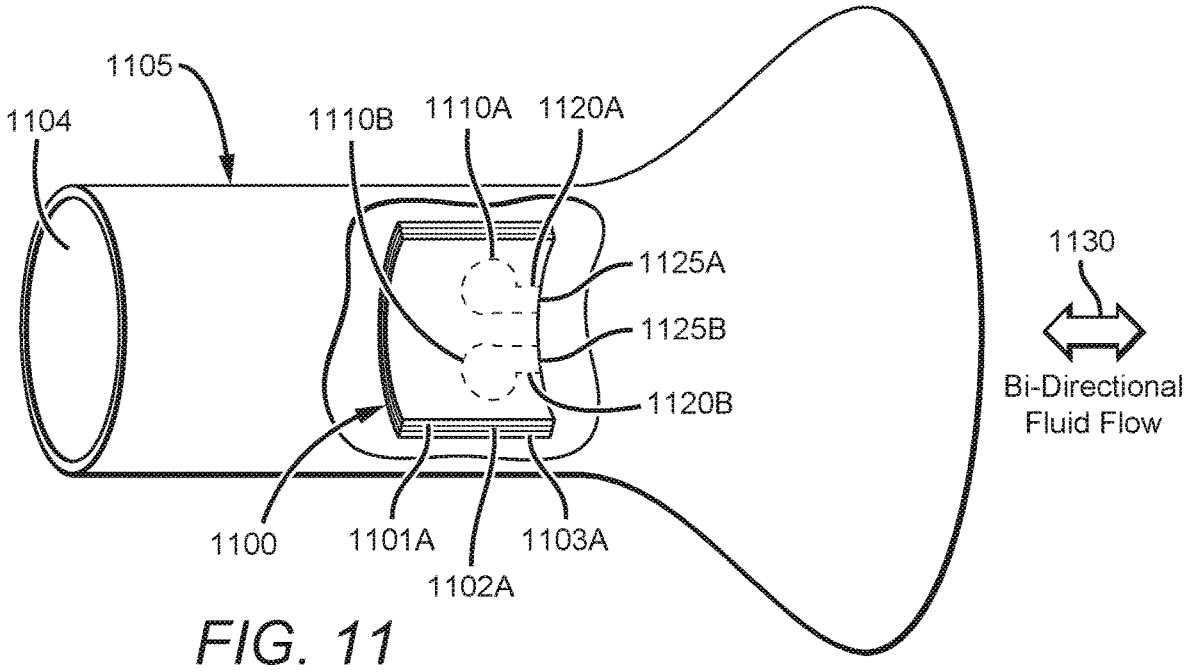
FIG. 11

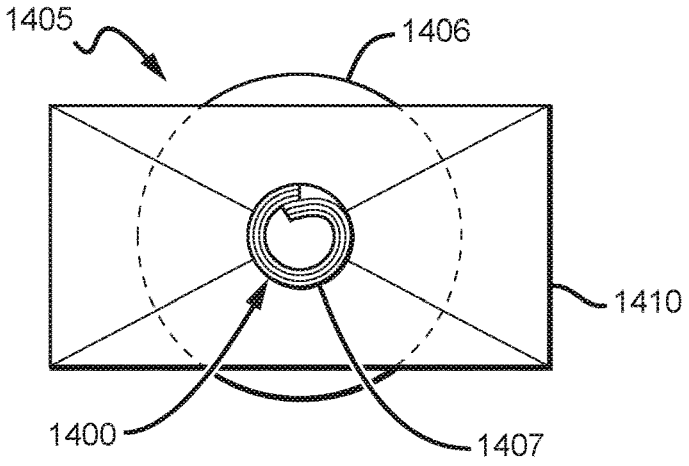
FIG. 14
FIG. 15
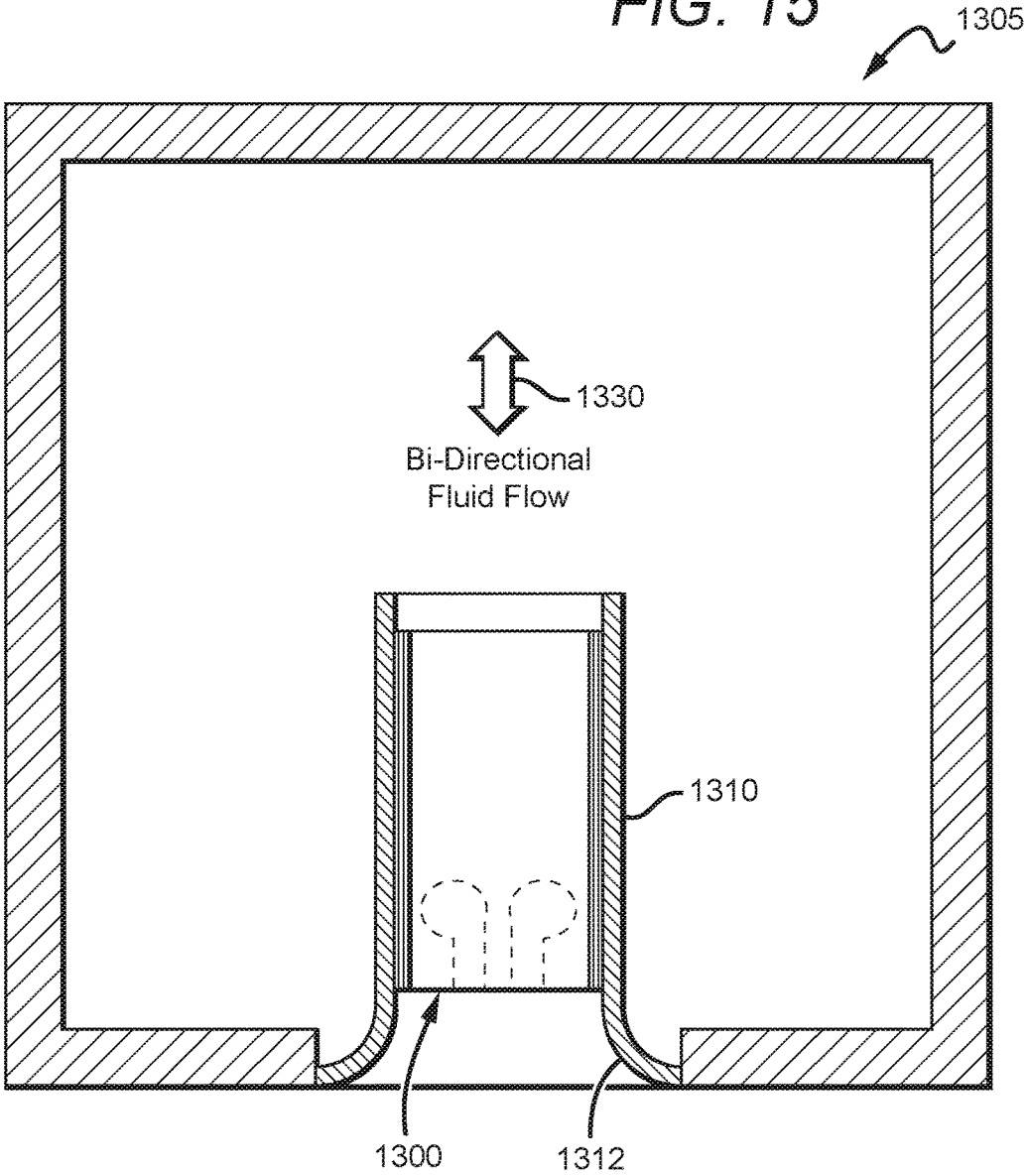

THIN FILM RESONATORS

This application claims priority to U.S. provisional application Ser. No. 62/572,286, filed Oct. 13, 2017.

FIELD OF THE INVENTION

The field of the invention is fluid dynamics, and especially acoustic fluid dynamics.

BACKGROUND

The background description includes information that may be useful in understanding the present invention. It is not an admission that any of the information provided herein is prior art or relevant to the presently claimed invention, or that any publication specifically or implicitly referenced is prior art.

My previous application, Ser. No. 62/548,343, described use of wavy riblets and other surface features within the port of a speaker enclosure, microphone, or musical instrument to reduce turbulence of the air flow within the boundary layer between the mean flow and the surface of the port.

There are, however, additional improvements that can be made to sound devices, using Helmholtz-like resonators. For example, "Separation Control by Flow-Induced Oscillations of a Resonator", Urzynicok, Frank, U. of Berlin, 2003, describes use of paired Helmholtz-like resonators. Additional work was described in "PIV Application to Fluid Dynamics of Bass Reflex Ports, Massimiliano, Rossi et al, Dept of Mechanics, U. Politecnca delle Marche, pages 259-270, Springer Publ, 2008. Yet other work was described in "Numerical study of the aerodynamics of sound sources in a bass-reflex port", Garcia-Alcaide, V. M. et al, Engineering Applications of Computational Fluid Mathematics, 11:1, 210-224, 2017.

The priority application, the '343 application, and all publications referenced herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Despite all the work that has been done in this field, there is still a need for systems and methods that reduce distortion and/or improve other sound qualities of speakers, musical instruments, microphones and other devices having an important auditory component.

SUMMARY OF THE INVENTION

The inventive subject matter provides apparatus, systems and methods in which thin film resonators are deployed in the port ducts of speakers, musical instruments, microphones and other devices having an important auditory component, to reduce distortion and/or improve other sound qualities.

Preferred embodiments include a thin film resonator having a resonator sheet with a first air cavity, and a passageway in an edge of the resonator sheet that opens to the air cavity. The cavity is further defined by a cover sheet, and most preferably also a base sheet. The sheets are preferably bonded together by an adhesive. In some embodiments, an edge of the cover sheet and/or an edge of the base sheet overhangs a corresponding edge of the resonator sheet.

Thin film resonators can advantageously comprise a flexible polymer, and have a nominal thickness of 125 μm-300 μm. Flexible thin film resonators can advantageously be rolled up inside the sound duct of a speaker enclosure, a musical instrument, or any other duct through which air is flowing. Where sound waves carrying music or other desirable sounds are passing through a duct modified in this manner, the quality of the sound is improved by reducing turbulence and associated vortex shedding of air flowing across surfaces of the duct.

Whether flexible or not, resonators can also be disposed onto a substantially flat surface, as for example on a fan blade or an HVAC duct. In such instances the resonator can reduce undesirable noises that would otherwise be produced by air passing over the surface.

Resonators can be applied during and/or post manufacturing.

The cavities, passageways and openings can be of any suitable sizes and shapes, although experimentation has shown that the cavities work best when having elliptical shapes that are positioned off normal from the passageways. Some contemplated resonators have multiple air cavities, with their associated passageways and opening. Preferred embodiments have mirror image pairs opening to the same edge of the resonator. It is also contemplated for resonators to have pairs of air cavities, with their associated passageways and opening, on opposite edges of a given resonator.

Various objects, features, aspects and advantages of the inventive subject matter will become more apparent from the following detailed description of preferred embodiments, along with the accompanying drawing figures in which like numerals generally represent like components.

BRIEF DESCRIPTION OF THE DRAWING

FIGS. 5A-5E are plan views of portions of resonator sheets having different shaped passageways opening to the respective air cavities.

FIG. 6A is a plan view of a resonator sheet having a cover sheet and a base sheet that extends beyond both edges of the resonator sheet.

FIG. 10 is a perspective view of a fan blade, with detail of a resonator device adhered to the blade.

FIG. 11 is a partial cutaway view of a flared air passageway, with a three-layer resonator.

FIG. 14 is a top view of a compression driver of a speaker having a three-layer resonator device disposed in the throat duct, and showing a rectangular waveguide.

FIG. 15 is a horizontal cross-section of the speaker housing of FIG. 13, through 15-15.

DETAILED DESCRIPTION

Figure 1:
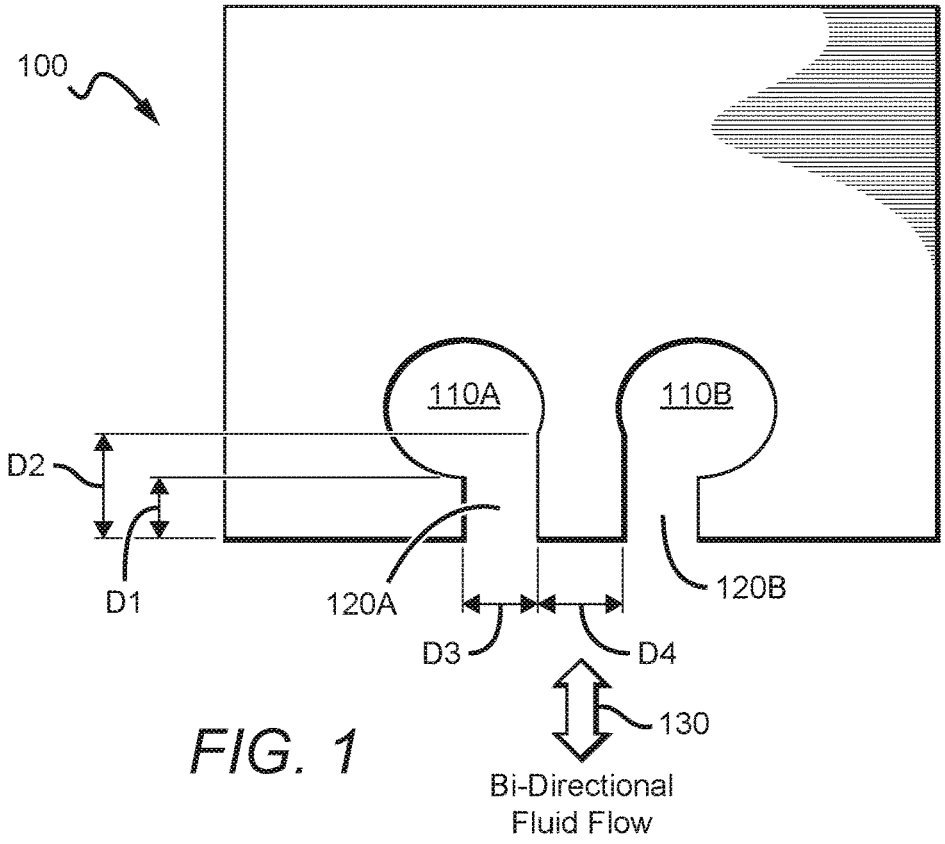
FIG. 1 is a plan view of a resonator sheet having first and second passageways that open to first and second resonator cavities, respectively.

The following description includes information that may be useful in understanding the present invention. It is not an admission that any of the information provided herein is prior art or relevant to the presently claimed invention, or that any publication specifically or implicitly referenced is prior art.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

One should appreciate that the disclosed devices and techniques provide many advantageous technical effects resulting from reducing turbulence and associated vortex shedding of air flowing across a surface.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

FIG. 1 is a plan view of a resonator sheet 100 having first and second passageways 120A, 120B, that open to first and second resonator cavities 110A, 110B, respectively.

The resonator sheet 100 is preferably a flexible plastic film, but could also be a thin sheet of metal, wood veneer, paper, glass or other ceramic. Contemplated plastics include polypropylene; polycarbonate, hard coated or abrasion resistant or UV grades (PC), PDMS (polydimethylsiloxane), PET, Polytetrafluoroethylene (PTFE), and silicone rubber.

Especially preferred materials for the resonator sheet 100 are viscoelastic, because (1) it is highly advantageous for sheet to be sufficiently flexible so that the resonator can be rolled up inside the lumen of a duct of virtually any cross-sectional diameter or shape, (2) such materials are thought to help isolate vibrations across the resonator, and (3) such materials are thought to bond well to a polycarbonate cover sheet, and/or a base sheet. For ease of manufacturing thin film resonators, it has been found that resonator sheet 100 can advantageously be a solid acrylic viscoelastic with adhesives on both sides.

One advantage of thin-film resonators is that they can be added to inner walls of ducts and surfaces and can be deployed in post-manufactured products.

In FIG. 1, resonator sheet 100 is depicted without any surface texture or other surface features. Experimentation has shown that it preferable for the surface juxtaposing the cover sheet (not shown) to be smooth to help ensure a good seal against the cover sheet. Where a base sheet (not shown) is utilized, it is also preferable, but experimentation has shown it to be not quite so important, for the surface facing the base sheet to be smooth to provide a good seal against the base sheet.

Regardless of the material used, it is advantageous for the resonator sheet to have adhesive on both major surfaces. In such circumstances the top-facing adhesive seals the resonator sheet to the cover sheet, and the bottom-facing adhesive seals the resonator sheet to either the base sheet, or whatever surface the resonator is being applied to. Without having good seals, the resonator cavities are not properly defined. Although one could provide adhesive on the cover sheet instead of the resonator sheet, that embodiment would likely reduce performance by including at least some adhesive on the underside of the coversheet positioned above the resonator cavities. Preferred adhesives are those that bond well to polycarbonate films. UV curable adhesives are also preferred because they can aid in ease of manufacturing and can also bond well to polycarbonate films. Silicone adhesives are also contemplated. Still further, it is contemplated that the two or all three of the cover sheet, resonator sheet, and base sheet could be pressure and/or heat laminated.

At least where the resonator cavities operate as air cavities, resonator sheets preferably have a nominal thickness of 125 μm-300 μm, and resonator sheet 100 should be interpreted accordingly. On the other hand, experimentation has found resonators to be useful having nominal thicknesses as thin as 25 μm, and as high as 800 μm. Nevertheless, resonator sheets thinner than 400 μm are generally thought to be more practical where they need to be rolled, or otherwise curved, to fit within a curved duct.

It should be appreciated that resonator cavities 110A, 110B are not positioned normal to the end of the respective passageways 120A, 120B, but are instead positioned off to the side. Thus, length D1 in FIG. 1 is less than length D2.

The volumes of the resonator cavities are determined by the thickness of the resonator layer, and the cross-sectional area of the cavities. These volumes can be optimized according to the sonic spectrum that one wants to include or exclude. Larger cavities tend to couple with lower frequencies. For speaker port ducts and musical instrument passageways, the volumes are preferably between 12.5 $mm^3$ and 300 $mm^3$. Preferred cross-sectional areas are at least 300 $mm^2$. For fluid coupling purposes, a second, coupled fluid cavity (e.g., fluid cavity 110B is coupled to fluid cavity 110A) should have a similar cross-sectional area to that of the first fluid cavity. Preferably the second fluid cavity should have a cross-sectional area that is within 20% of the cross-sectional area of the first air cavity, more preferably within 10%, and most preferably within 5%.

Surprisingly, it turns out that the dimensions of D1, D2, D3, and D4 have significant effects on how well the resonator performs. Considerable experimentation has been done for resonator cavities operating as air cavities, to establish that length D1 should be at least 1 mm long, preferably at least 3 mm long. D1 is preferably less than 50 mm, and more preferably 6 mm to 25 mm, and most preferably 8 mm-18 mm. Length D2 should longer than D1. For air cavities D2 is preferably at least 2 mm, more preferably at least 4 mm long, but preferably less than 65 mm, and more preferably 7 mm to 40 mm, and most preferably 10 mm-25 mm. Width D3 is preferably 2 mm-25 mm, more preferably 4 mm to 20 mm, and most preferably 5 mm-15 mm. Dimensions outside those parameters appear to be much less effective in reducing distortion, at least when used in port ducts of speakers, and air passageways of musical instruments.

At least where the resonator cavities operate as air cavities, the Applicant has also surprisingly discovered that separation distance D4 is important to provide fluid mechanical coupling between neighboring resonator cavities 120A, 120B. And again, at least where the resonator cavities operate as air cavities, it turns out that a single pair of air cavities outperforms a single air cavity, as well as a coupled triplet of three air cavities. And in general, even numbers of coupled air cavities seem to outperform odd numbers of coupled air cavities.

Fluid flow in FIG. 1 is bidirectional or unidirectional, as depicted by arrow 130. This has importance because it turns out that, at least where the resonator cavities operating as air cavities, even a single pair of resonator cavities 110A, 110B facing in only one direction is effective to reduce air flow distortions and vortex shedding, whether the air flow is unidirectional (into the passageways) or bidirectional. In speaker ports, for example, it turns out that reduction of air flow distortions and vortex shedding of air flowing into a speaker housing through a port duct can have a greater effect on sound quality than air flowing in the other direction.

In each of FIGS. 1, 2, 3, 4A-4C, 5A-5E, 6A-6B, 7A-7B, depictions of relative sizes and shapes of the resonator cavities, passageways and openings should be interpreted as approximations. However, other components, such as thicknesses of the various sheets in FIGS. 6B and 7B, should not necessarily be interpreted as being in proportion.

Figure 2:
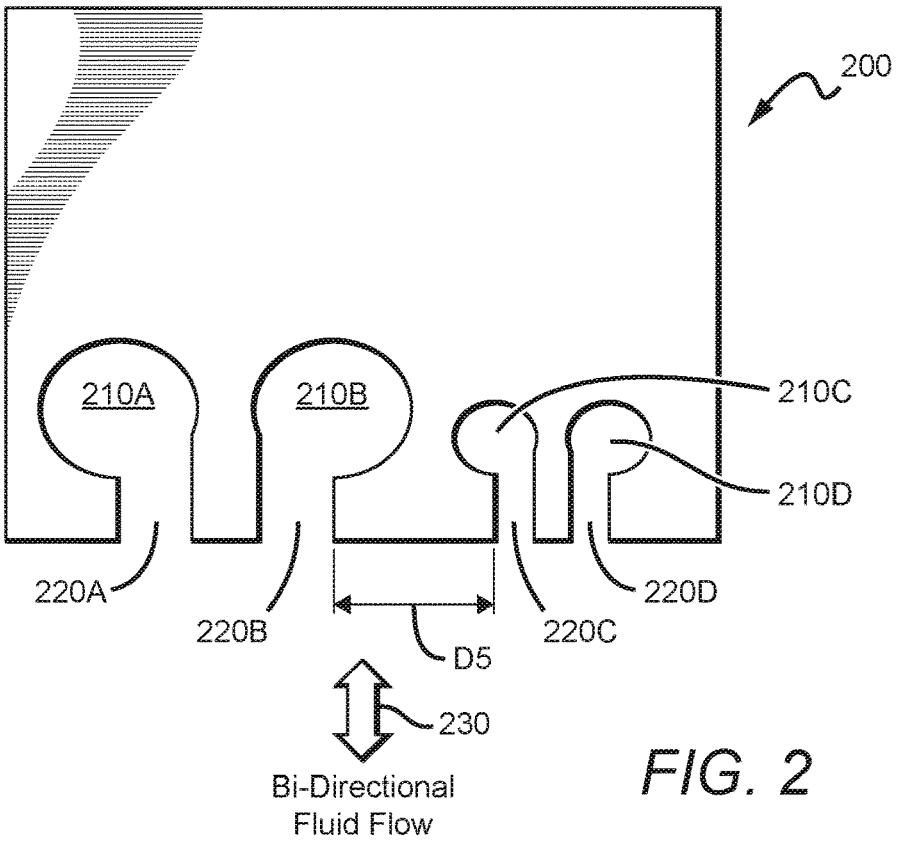
FIG. 2 is a plan view of a resonator sheet having two differently sized pairs of air cavities, with their associated passageways.

FIG. 2 is a plan view of a resonator sheet 200 having two differently sized pairs of resonator cavities, with their associated passageways. In this example, the first pair of resonator cavities 210A, 210B are fluidly connected to passageways 220A, 220B, respectively. A second pair of resonator cavities 210C, 210D are fluidly connected to passageways 220C, 220D, respectively.

There is a separation distance D5 between the two first and second pairs of resonator cavities. At least where the resonator cavities operating as air cavities, there appears to be no particular correlation between function of the resonators and distance D5. On the other hand, D5 should be at least 1 cm.

One should also appreciate that in FIG. 2, the first pair of air cavities 210A, 210B have essentially the same cross-sectional areas as each other, while the second pair of air cavities 210C, 210D have essentially the same cross-sectional areas as each other. However, the cross-sectional areas of the first pair of air cavities 210A, 210B is larger than the second pair of air cavities 210C, 210D. It turns out that it is advantageous to have different sizes of paired air cavities, because the different sizes tend to target different frequencies.

FIG. 2 has a bidirectional or unidirectional fluid flow 230 with respect to the openings of the resonator passageways 220A, 220B, 220C, and 220D.

Figure 3:
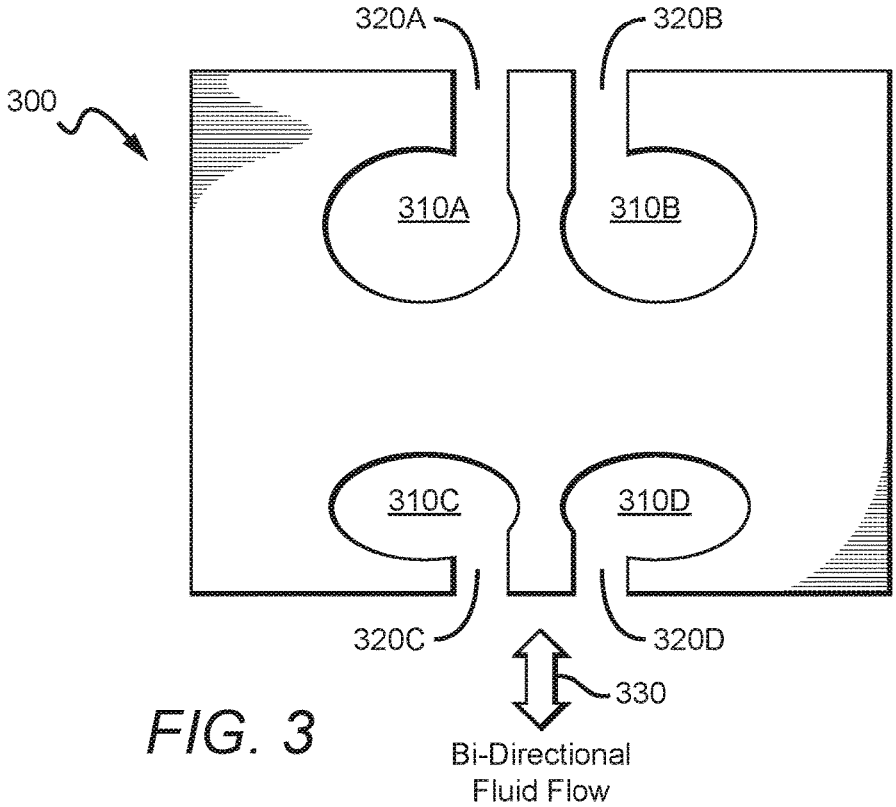
FIG. 3 is a plan view of a resonator sheet having a first pair of air cavities and associated passageways on one edge, and a second pair of air cavities and associated passageways on an opposite edge.

FIG. 3 is a plan view of a resonator sheet 300 having a first pair of resonator cavities 310A and 310B and their associated passageways 320A, 320B on one edge, and a second pair of resonator cavities 310C and 310D and their associated passageways 320C and 320D on an opposite edge.

The reader will note that the first pair of resonator cavities 310A and 310B are similarly sized to each other, and the second pair of resonator cavities 310C and 310D are similarly sized to each other. However, the first pair of resonator cavities is larger than the second pair of resonator cavities. In addition, all four of the resonator cavities are substantially elliptical, however, the first pair of resonator cavities 310A and 310B has a lower eccentricity than the second pair of resonator cavities 310C and 310D. Elliptically shaped resonator cavities tend to be more effective than circular ones. Optimum eccentricities tend to be between 0.3 and 0.9. Other shapes besides elliptical and circular resonator cavities are also contemplated, including polygonal and non-Euclidian shapes.

The reader will also note that, passageways 320A, 320B are longer than passageways 320C and 320D. Other than guidance set forth herein, it seems that the optimum relationships among length and the width of the passageways, and volumes (or cross-sectional areas) of the different resonator cavities, needs to be experimentally determined for different circumstances.

FIG. 3 has a bidirectional or unidirectional fluid flow 330 with respect to the openings of the resonator passageways 320A, 320B, 320C, and 320D.

Figure 4A:
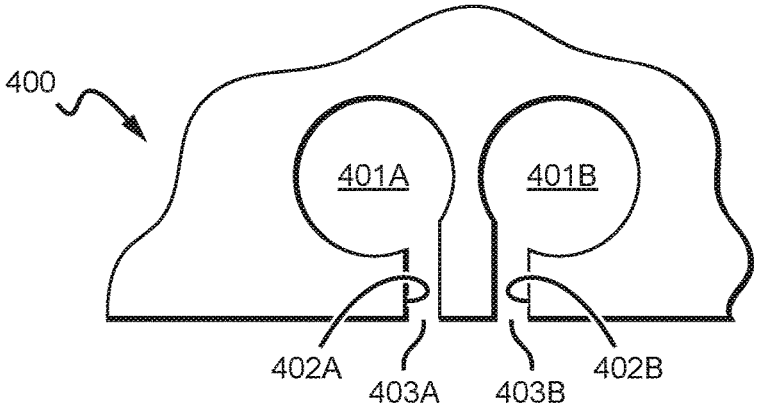
FIGS. 4A, 4B, and 4C are plan views of portions of resonator sheets having different shaped air cavities.
Figure 4B:
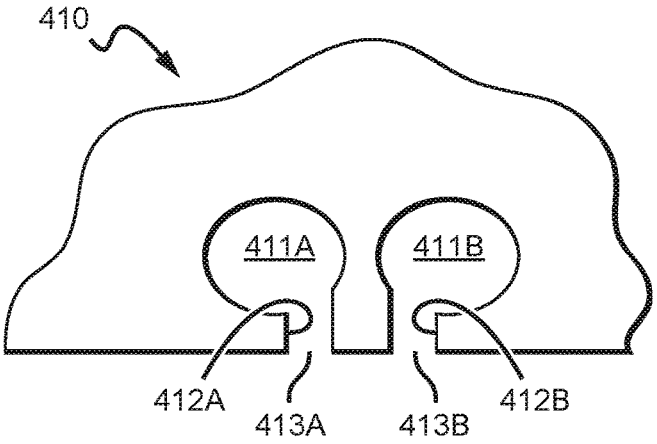
Figure 4C:
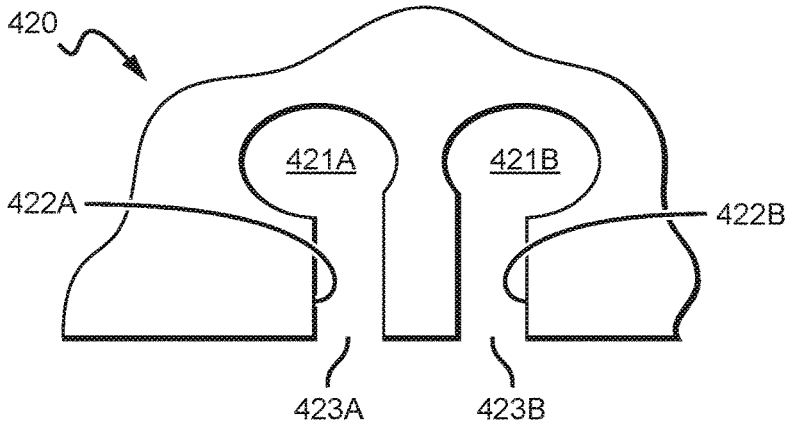
Figure 5A:
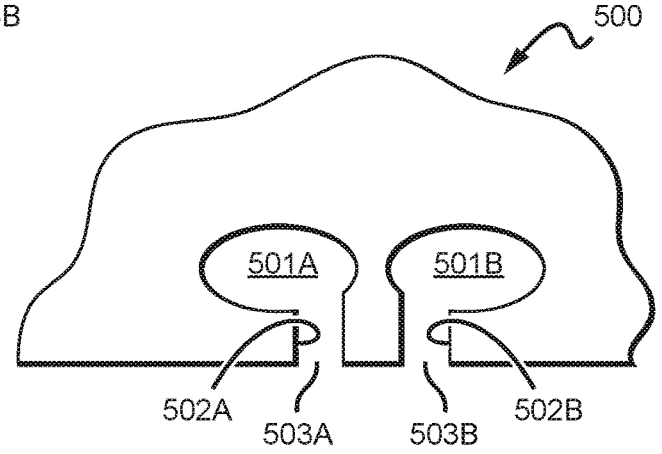
Figure 5B:
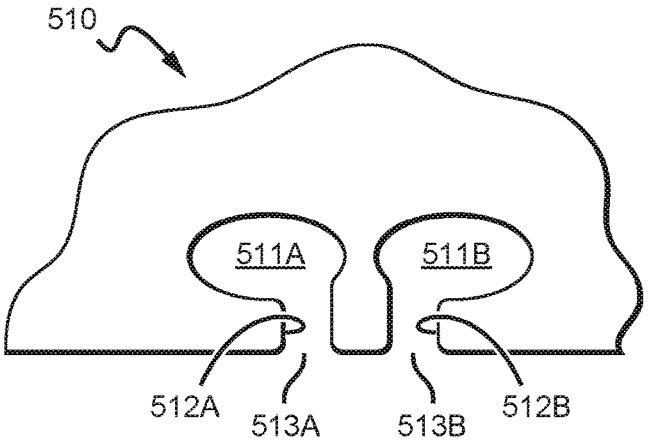
Figure 5C:
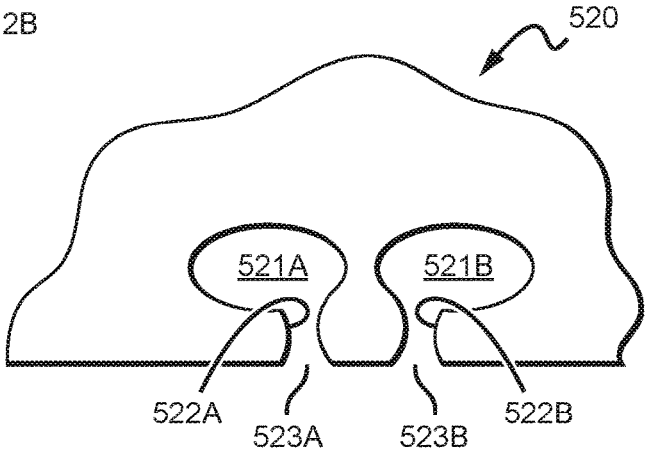

FIGS. 4A, 4B, and 4C are plan views of portions of resonator sheets 400, 410, 420 having different shaped resonator cavities, and different sized passageways.

Resonator sheet 400 has resonator cavities 401A, 401B, passageways 402A, 402B, and openings 403A, 403B. As depicted, passageways 402A, 402B is longer than passageways 412A, 412B in FIG. 4B.

Resonator sheet 410 has resonator cavities 411A, 411B, passageways 412A, 412B, and openings 413A, 413B. As depicted passageway 412A is about the same length as passageway 412B.

Resonator sheet 420 has resonator cavities 421A, 421B, passageways 422A, 422B, and openings 423A, 423B. Each of passageways 422A, 422B are longer and wider than passageways 412A, 412B in FIG. 4B.

FIGS. 5A-5E are plan views of portions of resonator sheets 500, 510, 520, 530, 540 having different shaped passageways opening to the respective resonator cavities.

Resonator sheet 500 has resonator cavities 501A, 501B, passageways 502A, 502B, and openings 503A, 503B. The openings 503A, 503B should be viewed as having sharp edges, and one side of each of the transitions from the passageways 502A, 502B to the respective resonator cavities 501A, 501B has a sharp corner.

Resonator sheet 510 has resonator cavities 511A, 511B, passageways 512A, 512B, and openings 513A, 513B. The openings 513A, 513B should be viewed as having rounded edges, and one side of each of the transitions from the passageways 512A, 512B to the respective resonator cavities 511A, 511B has a rounded corner.

Resonator sheet 520 has resonator cavities 521A, 521B, passageways 522A, 522B, and openings 523A, 523B. The openings 523A, 523B should be viewed as having rounded edges, and the side walls of the passageways 522A, 522B are curved, such that fluid flowing from the openings 523A, 523B to the resonator cavities 521A, 521B is constricted by the passageways 522A, 522B. In this particular embodiment, each of the transitions from the passageways 522A, 522B to the respective resonator cavities 521A, 521B has a sharp corner.

Resonator sheet 530 has resonator cavities 531A, 531B, passageways 532A, 532B, and openings 533A, 533B. The openings 533A, 533B should be viewed as having sharp edges, and the side walls of the passageways 532A, 532B are linear, but also non-parallel, such that the cross-sectional areas of the passageways 532A, 532B narrow from the openings 533A, 533B to the resonator cavities 531A, 531B. In this particular embodiment, each of the transitions from the passageways 532A, 532B to the respective resonator cavities 531A, 531B has a sharp corner. It is contemplated that appropriate narrowing of the cross-sectional areas of the passageways 532A, 532B from the openings 533A, 533B to the resonator cavities 531A, 531B should be less than 40%, but the amount of narrowing should be determined by experimentation for specific embodiments. In this particular embodiment, each of the transitions from the passageways 532A, 532B to the respective resonator cavities 531A, 531B has a sharp corner.

Resonator sheet 540 has resonator cavities 541A, 541B, passageways 542A, 542B, and openings 543A, 543B. The openings 543A, 543B should be viewed as having sharp edges, and the side walls of the passageways 542A, 542B are linear, but also non-parallel, such that the cross-sectional areas of the passageways 542A, 542B open from the openings 543A, 543B to the resonator cavities 541A, 541B. It is contemplated that appropriate expanding of the cross-sectional areas of the passageways 542A, 542B from the openings 543A, 543B to the resonator cavities 541A, 541B should be less than 40%, but the amount of narrowing should be determined by experimentation for specific embodiments. In this particular embodiment, each of the transitions from the passageways 542A, 542B to the respective resonator cavities 541A, 541B has a sharp corner.

Figure 6B:
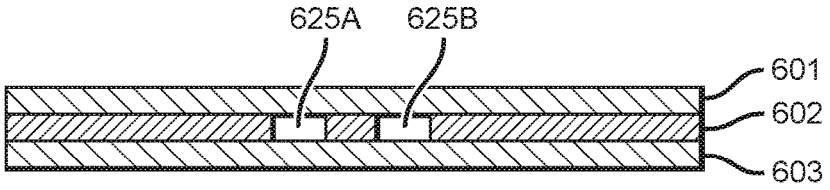
FIG. 6B is a vertical cross-section of the resonator of FIG. 6A taken at 6B-6B, showing a three layer construction of textured cover sheet, resonator sheet and base sheet.

FIGS. 6A and 6B depict a top view with partial cutaway, of a resonator 600 having a resonator sheet 602 sandwiched between a cover sheet 601, and a base sheet 603. The three-sheets 601, 602, 603 are laminated together using adhesives, heat, or other means. Arrow 630 indicates bidirectional or unidirectional air or other fluid flow. FIG. 6B is a vertical cross-section taken at 6B-6B and shows the three-sheet construction, and openings 625A, 625B.

The top surface of cover sheet 601 has a surface texture 605, which can be a native texture to the cover sheet 601, and/or could have wavy or other riblets as depicted in utility application Ser. No. 15/999,516. Alternatively, cover sheet 601 could have a smooth surface texture (not shown). Overhangs D10, D20 of cover sheet 601 and base sheet 603 can advantageously extend beyond an edge of the resonator sheet 602 by 1 mm-10 mm.

Resonator sheet 600 having first and second passageways 620A, 620B, that open to first and second resonator cavities 610A, 610B, respectively. Openings 625A, 625B open into passageways 620A, 620B, respectively.

The top surface of base sheet 603 is preferably sufficiently smooth to provide an airtight seal with the resonator sheet 602. Base sheet 603 can optionally extend beyond the resonator sheet 602, preferably by the same distances D1, D2 as cover sheet 601, but alternatively by some other distance(s). A portion of the top of base sheet 603 can be seen through the cutaway and resonator cavity 610A.

Figure 7B:
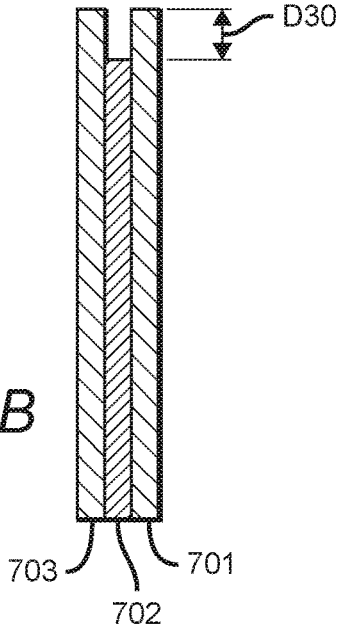
FIG. 7B is a vertical cross-section of the resonator of FIG. 7A taken at 7B-7B, showing a three layer construction of untextured cover sheet, resonator sheet and base sheet.
Figure 7A:
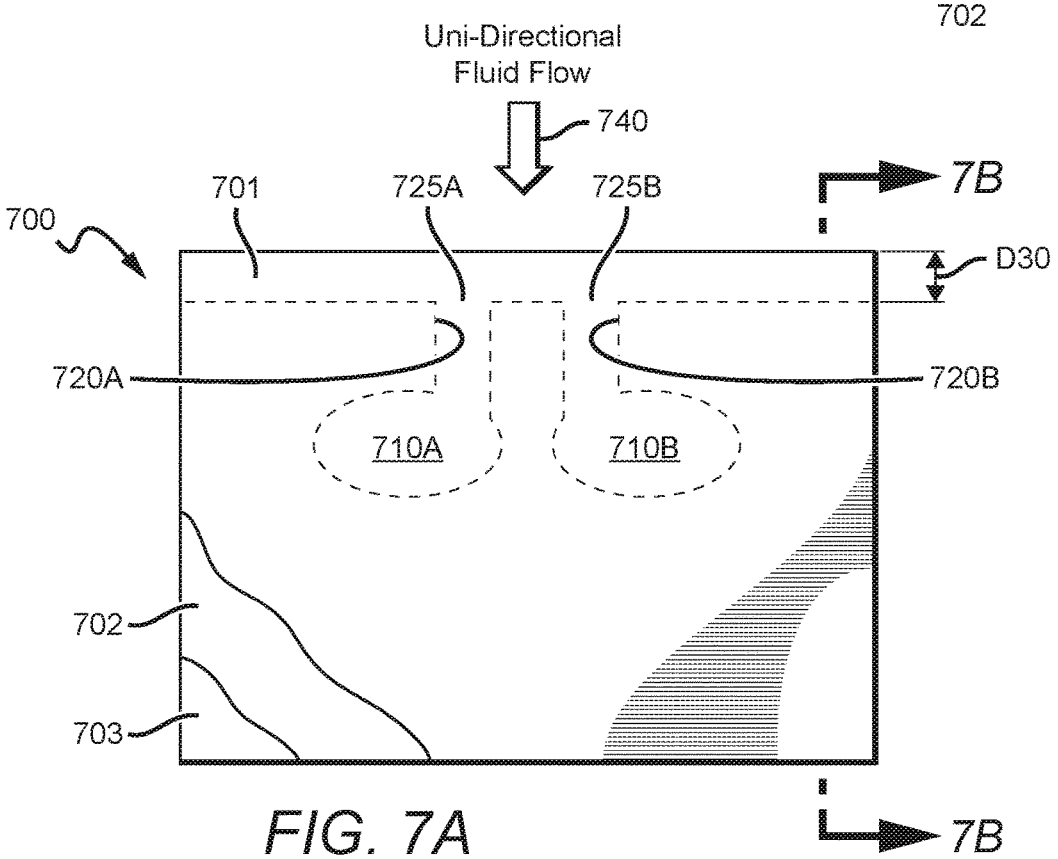
FIG. 7A is a plan view of a resonator sheet having a cover sheet and a base sheet that extends beyond one edge of the resonator sheet.

FIG. 7A is a plan view of a resonator 700 having a cover sheet 701, a resonator sheet 702, and a base sheet 703. The three-sheets 701, 702, 703 are laminated together using adhesives, heat, or other means. Cover sheet 701 and base sheet 703 extends beyond an edge of the resonator sheet 702 by a distance D30, only on one edge. Arrow 740 indicates unidirectional air or other fluid flow. FIG. 7B is a vertical cross-section taken at 7B-7B.

Resonator sheet 700 having first and second passageways 720A, 720B, that open to first and second resonator cavities 710A, 710B, respectively. Openings 725A, 725B open into passageways 720A, 720B, respectively.

FIG. 7B is a vertical cross-section of the resonator of FIG. 7A taken at 7B-7B, showing a three layer construction of untextured cover sheet 701, resonator sheet 702 and base sheet 703, and showing both cover sheet 701 and base sheet 703, extending beyond (i.e., overhanging the) resonator sheet 702.

Figure 8:
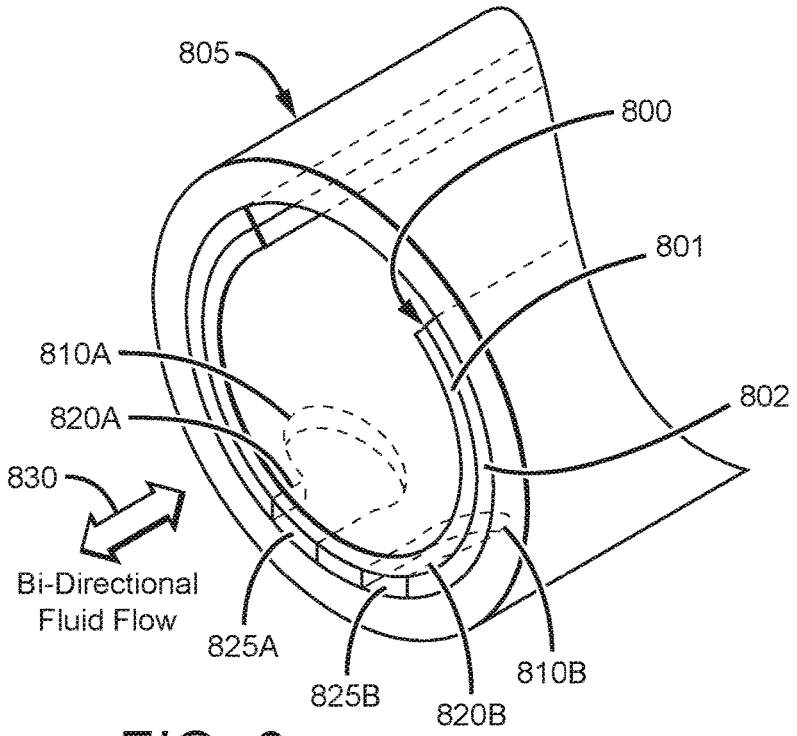
FIG. 8 is a perspective view of an end of a duct having a lumen in which is disposed a resonator having a resonator sheet and a cover sheet.

FIG. 8 is a perspective view of an end of a duct 805 having a lumen in which is disposed a rolled up resonator 800 having a cover sheet 801 laminated to a resonator sheet 802. The resonator sheet 802 has cutouts for the resonator cavities 810A, 810B, passageways 820A, 820B, and openings 825A, 825B. In this embodiment, the lateral ends of resonator 800 are not overlapping. The reader will note that in FIG. 8, there is no base sheet. The resonator sheet 802 is adhered by an adhesive directly to the inside of the duct 805.

Fluid flow in FIG. 8 is depicted by arrow 830 as bidirectional, however, in other embodiments fluid flow could be unidirectional. Duct 805 should be interpreted broadly as any sort of air duct in which air is flowing bi-directionally or unidirectionally. For example, duct 805 should be alternatively interpreted as any of a musical instrument passageway or a duct of a speaker housing.

Figure 9:
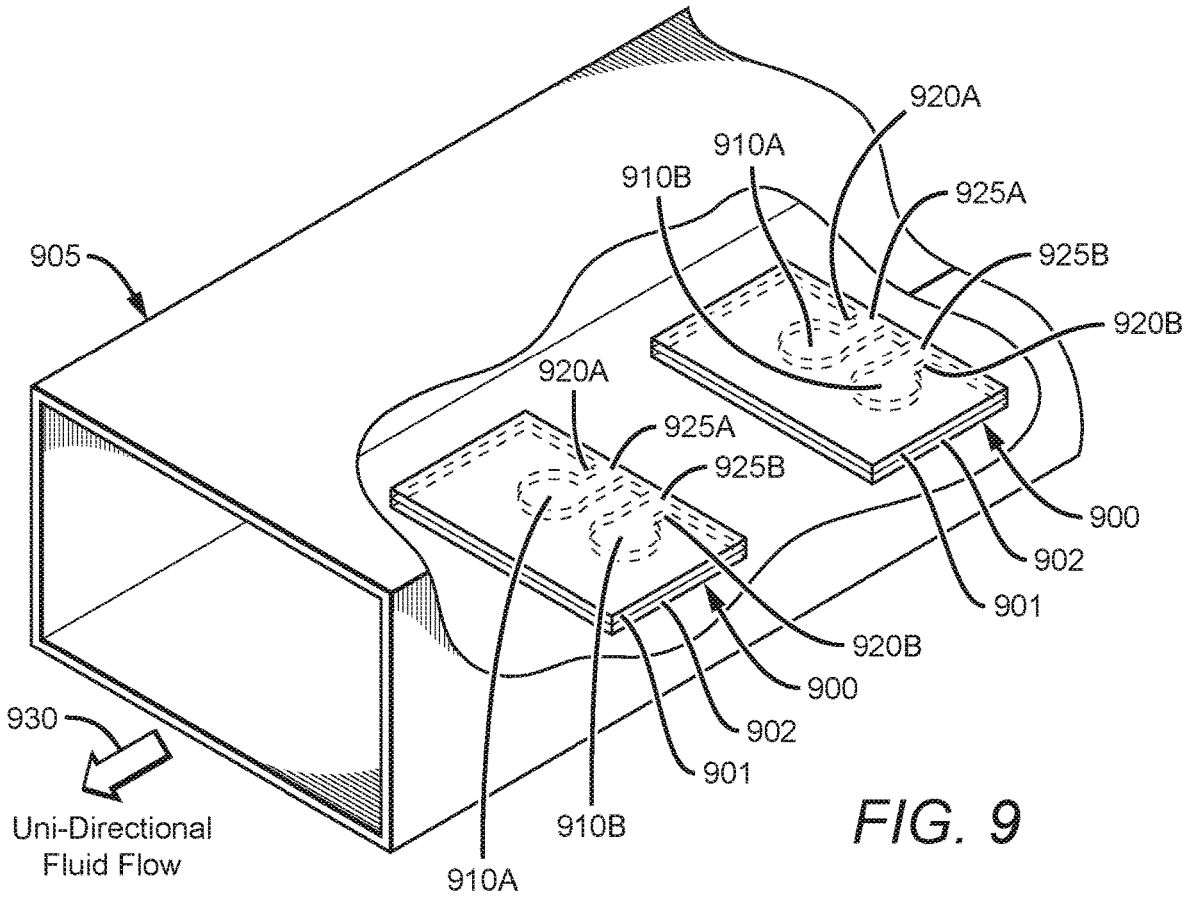
FIG. 9 is a partial cutaway view of an HVAC air duct having a lumen in which is disposed two resonator devices having a resonator sheet and a cover sheet.

FIG. 9 is a partial cutaway view of an HVAC air duct 905 having a lumen in which is disposed two resonators 900, each having a cover sheet 901 laminated to a resonator sheet 902. The resonator sheet 902 has cutouts for the resonator cavities 910A, 910B, passageways 920A, 920B, and openings 925A, 925B. Fluid flow in FIG. 9 is unidirectional, as depicted by arrow 930. Here also there is no base sheet. The resonator sheets 902 are adhered by adhesives directly to the inside of the duct 905.

FIG. 10 is a perspective view of a fan blade 1005, with detail of a resonator 1000 adhered to the blade 1005. As in several other embodiments described herein, the resonator 1000 has only two layers, a cover sheet 1001 and a resonator sheet 1002. There is no base sheet because resonator sheet 1002 is adhered directly onto a surface of the fan blade 1005. Alternatively, but not shown, one could have a three-layer resonator adhered to the blade.

The resonator sheet 1002 has cutouts for the resonator cavities 1010A, 1010B, passageways 1020A, 1020B, and openings 1025A, 1025B.

In FIG. 10, rotation of the fan blade 1005 is in direction 1006, such that unidirectional airflow is in the direction of arrow 1030. Fan blade 1005 couples to a fan pivot (not shown) by coupling 1007.

Surprisingly, it has experimentally been discovered that it is beneficial to position the resonator 1000 more towards the trailing edge of the blade 1005, with the openings 1025A, 1025B facing the leading edge of the blade 1005. It has also been experimentally discovered that the openings 1025A, 1025B need not address the direction of airflow 1030 normally. Thus, resonator 1000 can be rotated up to 30° each way off normal, as depicted by arrow 1040.

FIG. 11 is a partial cutaway view of a flared air passageway 1104. The passageway 1104 is defined by a duct 1105. This is similar in arrangement to FIG. 8, except that here the resonator 1100 is a three-layer device, having a cover sheet 1101A, a resonator sheet 1102A, and a base sheet 1103A, with the base sheet 1103A adhered onto an inner surface of the duct 1105. Resonator 1100 is rolled, but the lateral edges are not overlapping.

Unless the context indicates otherwise, all resonators contemplated herein can be rolled to have overlapping or non-overlapping edges, whether or not the resonators have a base sheet. It is also contemplated that the amount of overlap could comprise any one or more of the three-sheets, cover sheet, resonator sheet, and base sheet, and shown in FIG. 8 and FIG. 14.

The resonator sheet 1102A has cutouts for resonator cavities 1110A, 1110B, passageways 1120A, 1120B, and openings 1125A, 1125B.

Duct 1105 should be interpreted broadly to include any duct intentionally used to carry music, including for example, a bell of a horn, clarinet or other musical instrument, or a flared speaker port. Experimentally it has been shown that for these applications, it is particularly important that both the cover sheet 1101A and the base sheet 1103A extend beyond, (overhang) the resonator openings 1125A, 1125B (D10, D20) as described with respect to FIG. 6A. Also shown in FIGS. 7A, and 7B (D30). Arrow 1130 is bidirectional fluid flow in FIG. 11.

Figure 12:
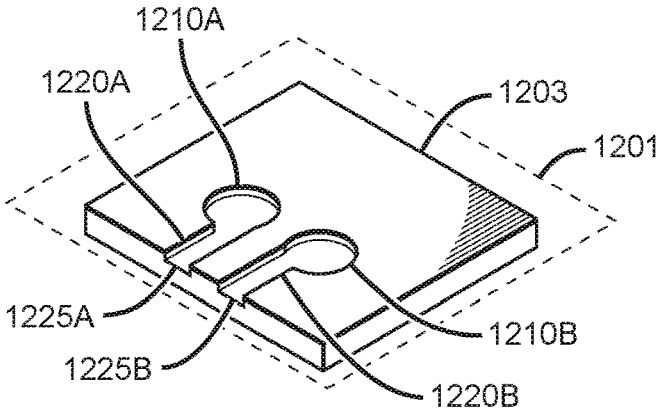
FIG. 12 is a perspective view of a resonator element other than a sheet, and showing a cover sheet.

FIG. 12 is a perspective view of a base 1203 suitable for machining, the base 1203 having cutouts for resonator cavities 1210A, 1210B, passageways 1220A, 1220B, and openings 1225A, 1225B. Such cutouts could, for example, be milled, molded or otherwise engineered into a wall of a musical instrument, speaker housing, HVAC, or other duct as described elsewhere herein. By placing an optional cover sheet 1201 (shown in dashed lines), one could achieve resonator effects described elsewhere herein.

Figure 13:
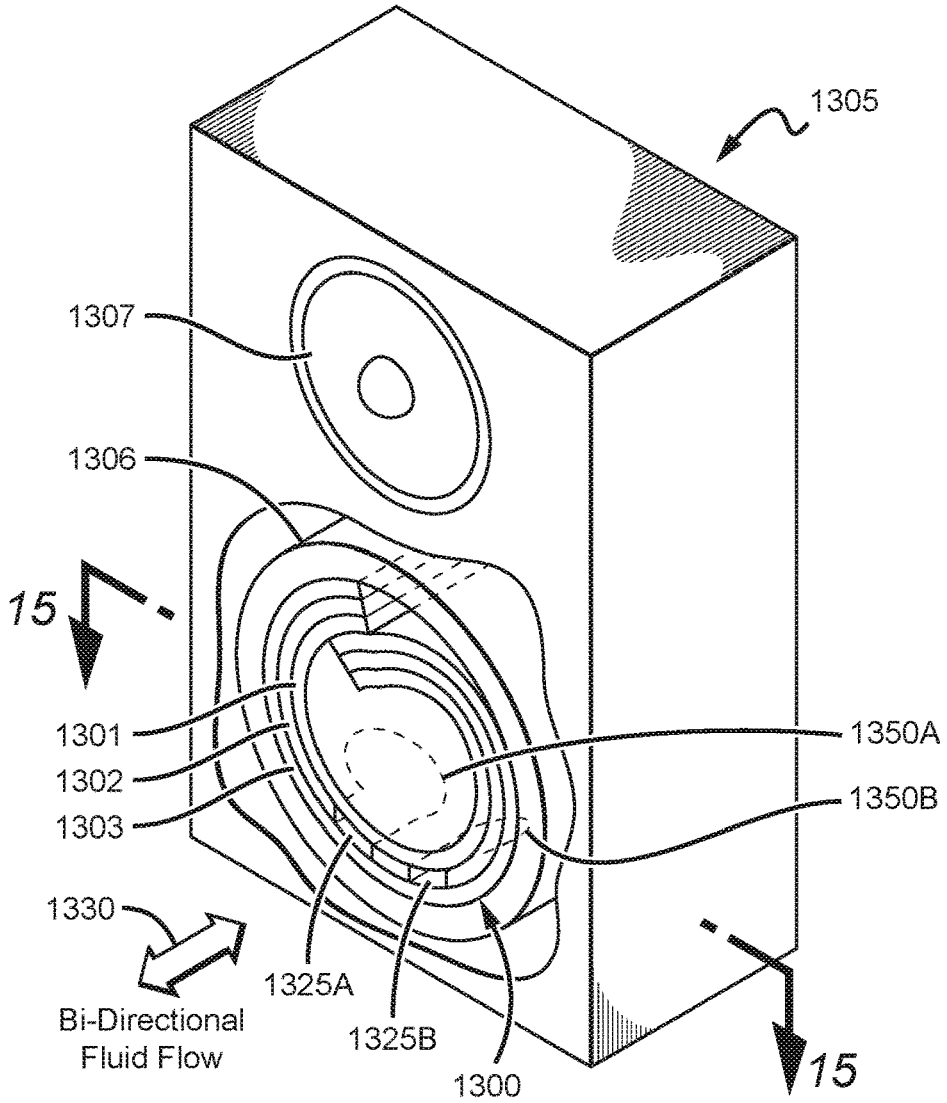
FIG. 13 is a perspective, partial cutaway view of a speaker housing having a three-layer resonator disposed in a port duct.

FIG. 13 is a perspective partial cutaway view of a speaker housing 1305 having resonator 1300 disposed in a port duct 1306. Also shown in speaker housing 1305 is a driver 1307.

Resonator 1300 has three layers, a cover sheet 1301, a resonator sheet 1302, and a base sheet 1303. Resonator sheet 1302 has cutouts 1350A, 1350B which collectively include resonator cavities, passageways, and openings. In this embodiment, the openings 1325A, 1325B face away from the speaker housing 1300, and has overlapping ends. Bidirectional airflow is indicated by arrow 1330.

FIG. 14 is a front view of a speaker 1405 having a compression driver 1406 and a rectangular wave guide 1410. Rolled up resonator 1400 is disposed in a throat duct 1407 of the compression driver 1406. Resonator 1400 preferably has three layers, but alternatively could have only two layers. Also, ends of resonator 1400 are preferably overlapping, similar to that shown in FIG. 14, but could also be non-overlapping, as shown in FIG. 8.

FIG. 15 is a horizontal cross-section of the speaker housing of FIG. 13, through 15-15. There is a flare 1312 in the duct 1310, and the resonator 1300 is positioned approximately where the flare portion 1312 joins the straight portion of duct 1310. Arrow 1330 indicates the bidirectional fluid flow.

Figure 16:
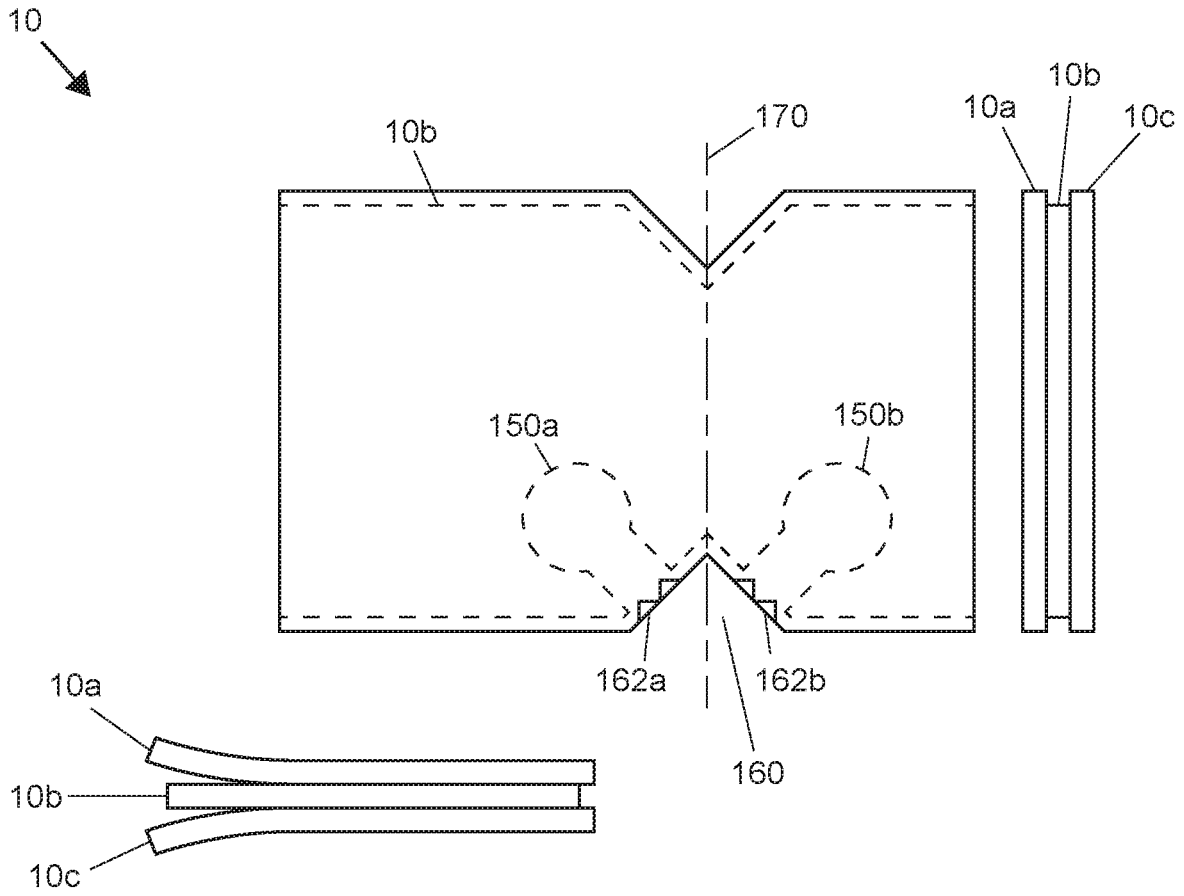
FIG. 16 is a top view of a preferred thin film resonator 10, including a cover (top) sheet 10*a* , an intermediate resonator sheet 10*b* , and a base (bottom) sheet 10*c*. In this particular example, the cover (top) sheet 10*a* ) and the base (bottom) sheet 10*c* overlap the intermediate resonator sheet 10*b*.

In FIG. 16, the boundaries of the passageway 160 can be smooth, or more preferable are jagged, scalloped, chevron'ed (16*a*, 162*b*)or otherwise patterned in some manner. The passageway 160 is depicted as having a shape that narrows from the edge inward to the air cavities, an that is thought to be desirable because such shapes tend to focus the grazing air flow.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A thin film resonator configured to remove distortion and improve other sound qualities, the resonator comprising:

a resonator sheet having:

a nominal thickness of 25 μm to 800 μm;

a first passageway leading to a first fluid cavity, wherein the passageway is at least 1 mm long, and the first fluid passageway has a smaller volume then the first fluid cavity;

a second passageway leading to a second fluid cavity, wherein the second passageway and the fluid cavity is mirrored image of the first passageway and the fluid cavity, and each of the first and second passageways open to a first edge of the resonator sheet; and a cover sheet that overlays the resonator sheet.

2. The resonator of claim 1 further comprising a base sheet disposed such that the resonator sheet is laminated between the cover sheet and the base sheet.

3. The resonator of claim 1 further comprising an adhesive disposed on at least one side of the resonator sheet.

4. The resonator of claim 1 wherein the resonator sheet comprises a flexible polymer.

5. The resonator of claim 1 wherein the resonator sheet has a nominal thickness of 125 μm - 300 μm.

6. The resonator of claim 1 wherein a surface of at least one of the sheets has a pattern of surface features.

7. The resonator of claim 1 wherein the first passageway has first and second ends, and narrows in width by at least 5% from the first end to the second end.

8. The resonator of claim 1, wherein the second passageway is distanced from the first passageway by at least 5 mm.

9. The resonator of claim 1, further comprising a third passageway opening to a third fluid cavity, and wherein the third passageway opens to a second edge of the resonator sheet opposite the first edge.

10. The resonator of claim 1, wherein the first fluid cavity has a cross-sectional area of at least 300 $mm^2$.

11. The resonator of claim 1, wherein at the first passageway, at least one of the cover sheet, and the base sheet extends beyond the resonator sheet by at least 1 mm.

12. The resonator of claim 1 is disposed within a speaker enclosure.

13. The resonator of claim 1 is disposed in an air passageway of a musical instrument.

14. The resonator of claim 1 is disposed in an air duct of an HVAC system.

15. The resonator of claim 1 is disposed on a rotating blade.

16. The resonator of claim 1, wherein the first passageway has a sidewall that is curved.

17. The resonator of claim 6, wherein the pattern of surface features includes chevrons.

18. The resonator of claim 1, wherein the resonator sheet comprises a thin sheet of metal.

19. The resonator of claim 1, wherein the resonator sheet has a hard surface.

20. The resonator of claim 1, wherein the cover sheet has a surface texture pattern.

21. The resonator of claim 1, wherein at least some portion of resonator has a series of chevrons.

22. The resonator of claim 1, wherein the resonator of claim 1 is disposed within a port or duct of a speaker, or throat duct of a compression driver.

23. The resonator of claim 1, wherein the first passageway is disposed off normal to the first fluid cavity.

24. The resonator of claim 1, wherein the resonator has first and second ends, and the first end overlaps the second end.

* * * * *